United States Patent [19]

Trubitsin et al.

[11] Patent Number: 4,488,688

[45] Date of Patent: Dec. 18, 1984

[54] COILING APPARATUS FOR LONG-SIZE PRODUCTS

[75] Inventors: Alexandr V. Trubitsin; Mikhail G. Polyakov; Georgy M. Fomin; Petr I. Denisov; Pavel E. Petrov; Petr P. Pomelnikov, all of Magnitogorsk, U.S.S.R.

[73] Assignee: Vsesojuzny Nauchno-Issledovatelsky Institut Metiznoi Promyshlennosti Vniimetiz, Magnitogorsk, U.S.S.R.

[21] Appl. No.: 364,844

[22] PCT Filed: Jul. 31, 1980

[86] PCT No.: PCT/SU80/00122

§ 371 Date: Mar. 23, 1982

§ 102(e) Date: Mar. 23, 1982

[87] PCT Pub. No.: WO82/00423

PCT Pub. Date: Feb. 18, 1982

[30] Foreign Application Priority Data

Jan. 10, 1978 [SU] U.S.S.R. ..... 2569265

[51] Int. Cl.[3] ..... B21C 47/02; B65H 17/20

[52] U.S. Cl. ..... 242/78; 226/187; 226/190

[58] Field of Search ..... 242/78, 80; 226/181, 226/186, 187, 190, 176, 177; 100/162 B, 171, 176

[56] References Cited

U.S. PATENT DOCUMENTS

| | | | |
|---|---|---|---|
| 2,292,851 | 8/1942 | Tykal | 226/186 |
| 2,668,615 | 2/1954 | Sampatacos | 226/186 |
| 2,704,794 | 3/1955 | Hanson | 226/190 X |
| 3,119,536 | 1/1964 | Berkeley | 226/190 X |
| 3,550,830 | 12/1970 | Lagogue | 226/187 X |
| 3,587,993 | 6/1971 | Tradler | 242/80 |
| 3,674,194 | 7/1972 | Moesser | 226/190 X |
| 3,675,837 | 7/1972 | Gerould | 226/187 |
| 4,043,494 | 8/1977 | Bickford et al. | 226/181 X |

FOREIGN PATENT DOCUMENTS

| | | |
|---|---|---|
| 1602348 | 10/1970 | Fed. Rep. of Germany . |
| 2426600 | 12/1973 | Fed. Rep. of Germany . |
| 113660 | 10/1957 | U.S.S.R. . |

*Primary Examiner*—Stuart S. Levy
*Assistant Examiner*—David Werner
*Attorney, Agent, or Firm*—Fleit, Jacobson, Cohn & Price

[57] ABSTRACT

A coiling apparatus for long-size products comprising an assembly for drawing long-size products and an assembly for coiling the long-size products, wherein said assemblies are disposed separately in the direction of movement of the long-size products. The assembly for drawing the long-size products incorporates at least one drive shaft and at least one spring-loaded roll wherebetween the long-size product moves, and also comprises a fork holding the spring-loaded roll, and a guide rack wherein the fork is inserted.

9 Claims, 6 Drawing Figures

COILING APPARATUS FOR LONG-SIZE PRODUCTS

TECHNICAL FIELD

The present invention relates to metallurgical production of hardware and, more specifically, to coiling apparatus for long-size products.

BACKGROUND ART

At the present time, improvement of industrial manufacture of long-size products is not possible without modification of the equipment serving for multihole drawing and coiling that would provide for fabrication of long-size products with residual stresses distributed symmetrically relative to the axis thereof, and, hence, for improvement of the fatigue life thereof. It is likely that most promising in this respect is a coiling apparatus designed for rectilinear drawing of the long-sized product coiled in such a manner that the moment of forces acting upon the product in a drawing-bending process should not exceed a certain critical value whereat a bending plastic strain begins.

However, the prior-art coilers widely in use do not preclude plastic bending of the long-size product during the drawing-bending process.

The coilers of the above-mentioned design are difficult to manufacture and labor-consuming in handling.

In addition, the prior-art coiling apparatus cannot provide for even drawing of the long-size product, with heavy vibration and operating instability occurring when a drawing speed of more than 60 to 70 m/min is reached, with the result that malfunctions are rather frequent.

Also known in the art is a coiling apparatus for long-size products (cf., U.S. Pat. No. 3,587,993, Cl. 242-80, dated July 10, 1971) comprising an assembly for drawing long-sized products and an assembly for coiling long-size products that are disposed separately in the direction of movement of the long-size products. In said apparatus, the assembly for drawing the long-size products comprises two rigidly-coupled shafts wherebetween the long-size product is passed.

The coiling apparatus of the foregoing design draws the long-size product by compressing it with the rolls thereof, with the result that the long-size product experiences plastic strains.

DISCLOSURE OF THE INVENTION

It is an object of the present invention to provide a coiling apparatus for long-size products, the construction of the assembly for drawing long-size products whereof will permit precluding plastic strains of the long-size products.

This object is accomplished in a coiling apparatus for long-size products comprising an assembly for drawing long-size products and an assembly for coiling long-size products disposed separately in the direction of movement of the long-size products, wherein, according to the invention, the assembly for drawing the long-size products incorporates at least one drive shaft and at least one spring-loaded roll wherebetween the long-size product is moved, and also comprises a fork carrying the spring-loaded roll, and a guide rack wherein the fork is inserted.

It is preferable that the drive shaft should be provided with principal flutes shaped identically to the long-size product, with the flute depth exceeding ½ of the long-size product thickness, and with the number of the flutes equal to the number of the spring-loaded rolls.

It is expedient that for drawing two long-size products pressed against the drive shaft with one spring-loaded roll, the drive shaft should be furnished with auxiliary flutes shaped identically to the long-size product, with the depth thereof exceeding ½ of the long-size product thickness, and with the number thereof equal to the number of the principal flutes.

For prolonging fatigue life, it is furthermore expedient that the drive shaft should carry a set of rings, the number whereof is equal to the number of spring-loaded rolls, with the surface of each ring provided with a principal flute shaped identically to the long-size product and having a depth exceeding ½ of the long-size product thickness.

For drawing two long-size products pressed against the ring by one spring-loaded roll, it is preferable that the surface of each ring be provided with an auxiliary flute shaped identically to the long-size product and having a depth exceeding ½ of the long-size product thickness.

To prolong fatigue life, it is likewise expedient that the rings be seated on the spring-loaded rolls.

It is no less preferable that the assembly for drawing long-size products should comprise rods for adjusting the pressure required to force the spring-loaded roll toward the long-size product, with the number of the rods equal to the number of the spring-loaded rolls.

It is also expedient that the assembly for drawing the long-size products should incorporate guides for the long-size products located before the drive shaft in the direction of movement of the long-size products, with the number of the guides equal to the number of the long-size products.

It is likewise expedient that a guide roll by installed after the drive shaft in the direction of movement of the long-size products.

It is an important advantage of the present invention that the apparatus provides for rectilinear drawing of the long-size product which does not experience plastic strains due to compression and bending occurring when a load is applied in the drawing-bending process, with the result that the efficiency in coiling the long-size products is substantially improved.

In addition, the present invention permits reducing the dimensions of the coiling apparatus for long-size products and the dimensions of the devices which employ the coiling apparatus.

BRIEF DESCRIPTION OF THE DRAWINGS

The invention will now be described in greater detail with reference to preferred embodiments thereof in conjunction with the accompanying drawings, wherein.

BEST MODES FOR CARRYING OUT THE INVENTION

Figure 1:
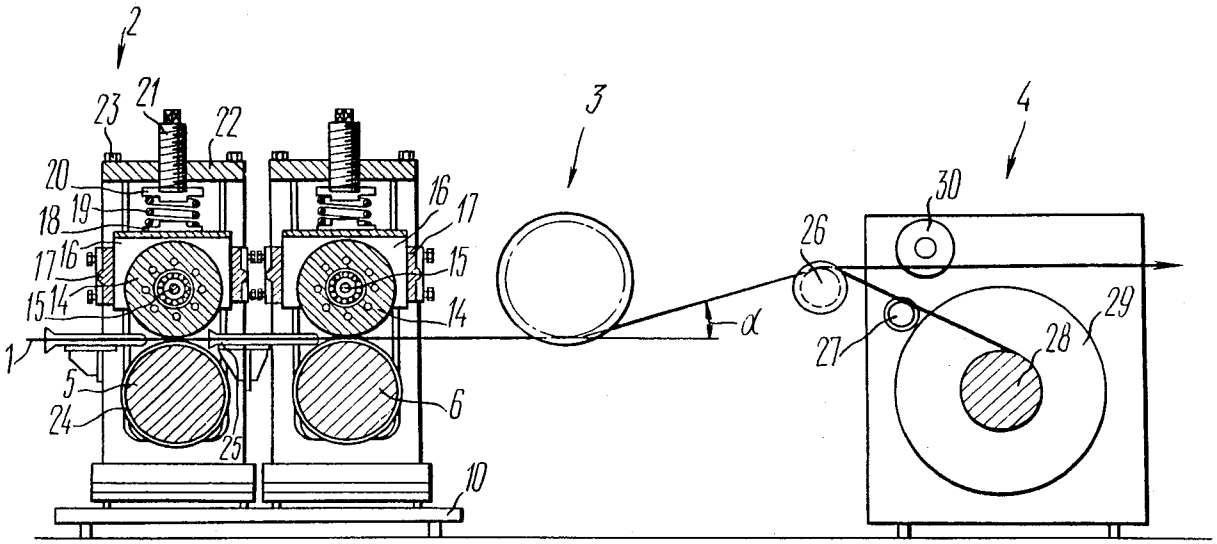
FIG. 1 is a structural diagram of a coiling apparatus for long-size products according to the invention (with an assembly for drawing long-size products shown in longitudinal section)

Referring to FIG. 1, the coiling apparatus for the long-size products comprises an assembly 2 for drawing a long-size product 1 (further referred to as wire), a guide roll 3 and an assembly 4 for coiling the wire 1.

Figure 2:
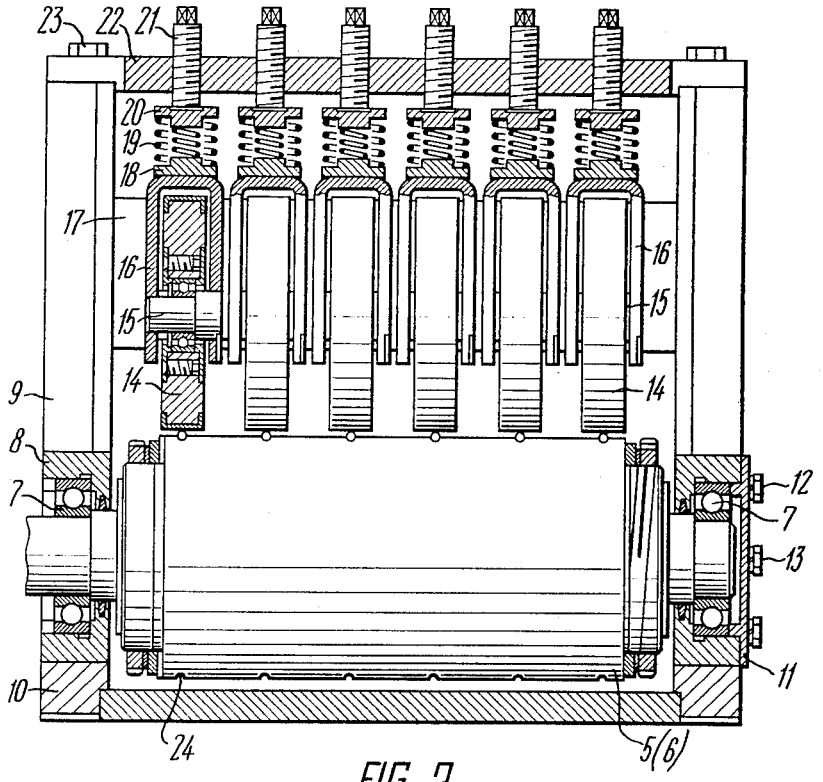
FIG. 2 shows the assembly for drawing long-size products of FIG. 1, with principal flutes machined in a drive shaft according to the invention (cross-sectional view)

The assembly 2 (ref. FIGS. 1 and 2) for drawing the wire 1 comprises two drive shafts 5 and 6 mounted in bearings 7 of fixed rests 8 of a post 9. The posts 9 are arranged on a mounting platform 10. Covers 11 of the bearings 7 located on one end of the shafts 5 and 6 are attached with screws 12 to the fixed rests 8. A lubricator 13 is arranged in the center of the cover 11. On the other end, the shafts 5 and 6 are coupled with a drive (not shown in the drawing).

Six spring-loaded rolls 14 are disposed above each shaft 5 and 6, with each roll held by a fixed rest 15 of a fork 16. The forks 16 are inserted into a guide rack 17, each being movable along the posts 9 and permitting vertical movement of the spring-loaded roll 14 above the respective shaft 5 or 6.

The top part of the fork 16 (in relation to the shafts 5 and 6) mounts a bottom rest 18 of a spring 19. A top rest 20 of the spring 19 is attached to a rod 21 attached by a thread joint to a cover 22 fastened to the post 9 by means of screws 23.

Flutes 24 made in the shafts 5 and 6 are shaped indentically to the wire 1 and have a depth exceeding ½ of the thickness of the wire 1, with the number of the flutes equal to the number of the rolls 14. Guides 25 of the wire 1 are arranged before each shaft 5 and 6 in the direction of movement of the wire 1.

The assembly 4 for coiling the wire 1 comprises a guide roll 26, a laying device 27 and a coiling device 28 carrying a coil 29, with the foregoing components arranged successively in the direction of movement of the wire 1. Besides, the assembly 4 incorporates a washer 30 serving for initial accumulation of the wire 1 when the coiling apparatus is to be set up, or for accumulation of the wire when the coil 29 must be replaced.

Figure 3:
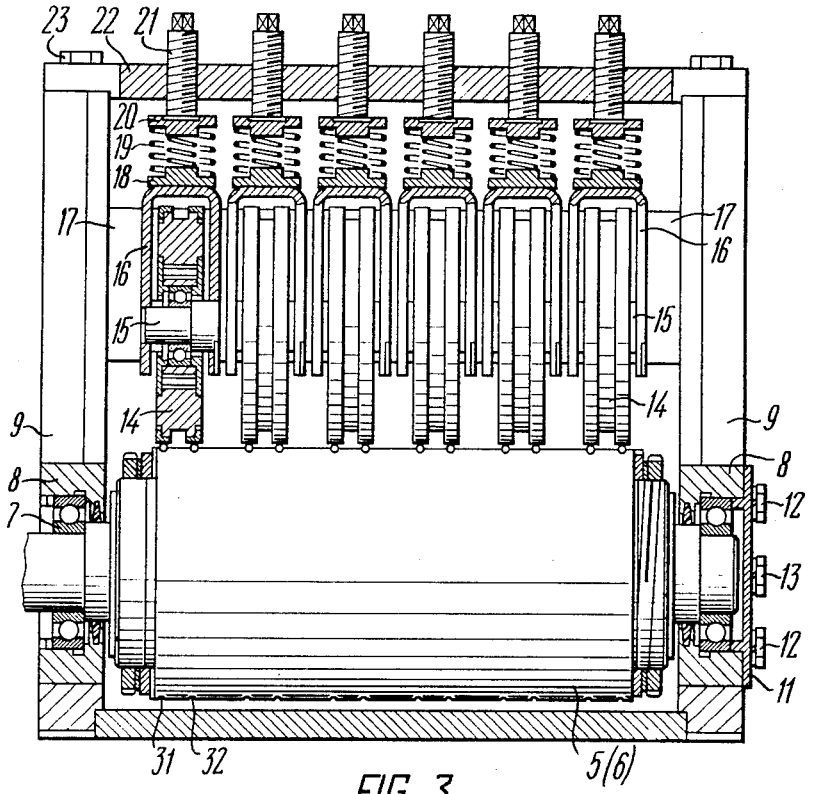
FIG. 3 shows the assembly for drawing long-size products of FIG. 1, with principal and auxiliary flutes machined in the drive shaft according to the invention (cross-sectional view)

In another embodiment of the coiling apparatus for the wire 1, each shaft 5 and 6 is provided with two flutes 31 and 32, with the assembly 2 adapted for drawing two wires 1 (ref. FIG. 3) which are pressed to the drive shaft 5 (6) by means of one spring-loaded roll 14.

Figure 4:
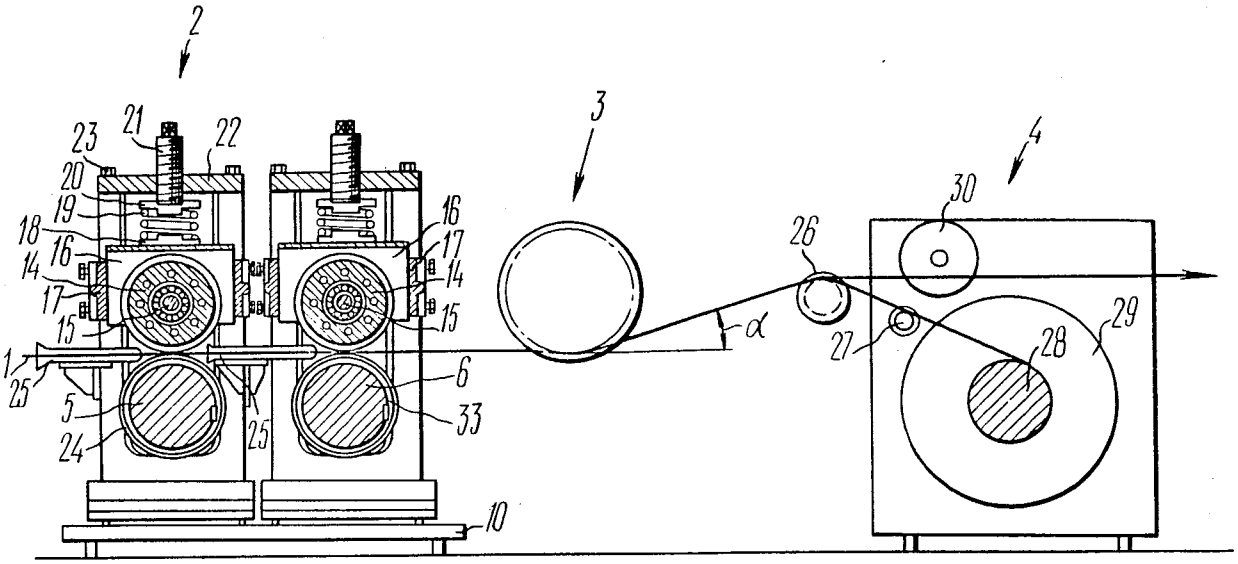
FIG. 4 is a structural diagram of the coiling apparatus for long-size products according to the invention, with rings seated on the drive shaft (with the assembly for drawing the long-size products shown in longitudinal section)
Figure 5:
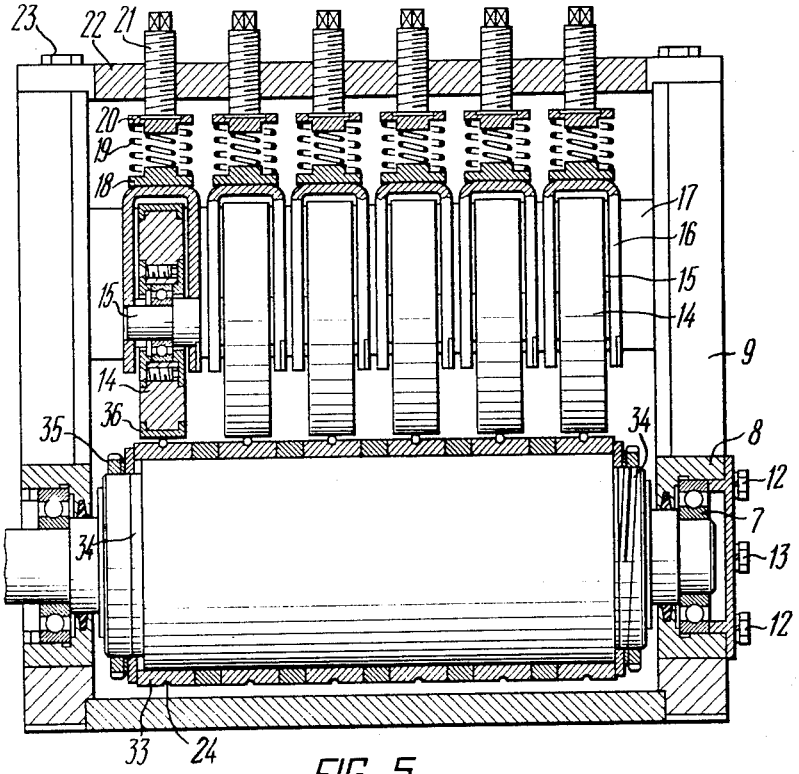
FIG. 5 shows the assembly for drawing long-size products of FIG. 4, with the principal flutes machined in the rings according to the invention (cross-sectional view)

Still another embodiment of the coiling apparatus for the wire 1 comprises the assembly 2 wherein the shafts 5 and 6 (ref. FIGS. 4 and 5) carry closely-fitted rings 33, with the number of the rings equal to the number of the rolls 14, and with the ring surfaces provided with flutes 24 identical in shape to the wire 1 and having a depth exceeding ½ of the thickness of the wire 1. The rings 33 can be made of any conventional wearproof material. Both ends of the shafts 5 and 6 are provided with circular projections 34 whereto check rings 35 are attached. The rolls 14 mount rings 36.

Figure 6:
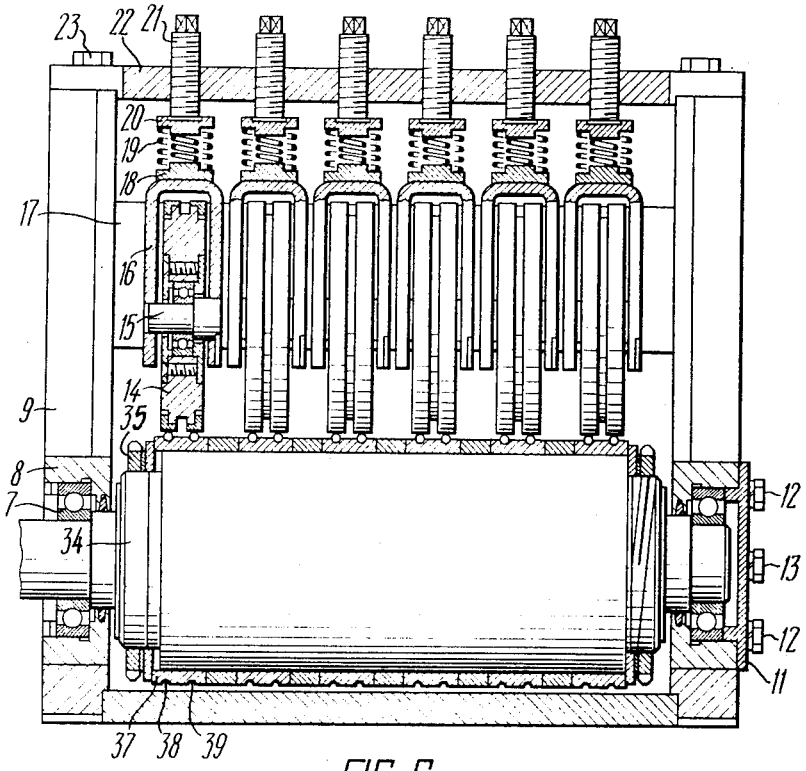
FIG. 6 shows the assembly for drawing the long-size products of FIG. 4, with the principal and auxiliary flutes machined in the rings according to the invention (cross-sectional view).

Another embodiment of the coiling apparatus for the wire 1 incorporates the assembly 2 (ref. FIGS. 4 and 6) for drawing two wires 1 pressed against the shaft 5 (6) by one roll 14, wherein the shafts 5 and 6 mount rings 37 provided with two flutes 38 and 39.

The coiling apparatus for wire according to the present invention operates as follows.

The wire 1 (ref. FIGS. 1, 2, 4 and 5) is fed to the guides 25 which direct it to a first couple including the shaft 5 and one spring-loaded roll 14. Said couple catches the wire 1 and acts upon it by a drawing force resulting from frictional forces produced between the wire 1 and the drive shaft 5. The flutes 24 in the drive shaft 5 shaped identically to the wire 1 provided for increasing the contact area between the wire 1 and the drive shaft 5, whereby the drawing force rises.

The reaction of the spring-loaded roll 14 serving to clamp the wire 1 to the drive shaft 5 is directed oppositely to movement of the wire 1, and the working surface of said roll 14 is therefore smoothly machined.

The wire 1 caught by the first couple of the drive shaft 5 and one spring-loaded roll 14 is fed along the guides 25 to a second couple including the drive shaft 6 and one spring-loaded roll 14.

The drawing force acting on one wire 1 is proportional to the compressing force exerted by the rod 21 on the spring 19, and to the number of the shaft/roll couples.

The wire 1 emerging from the assembly 2 is directed to the guide roll 3. The bending force acting on the wire 1 moving over the guide roll 3 must be elastic. The maximum permissible angle formed during the drawing-bending procedure is estimated according to the physical-chemical properties of the material of the wire 1, and to the shape and size thereof, and may not exceed a definite critical value whereat the bending plastic strain begins.

The wire 1 moving from the roll 3 is directed to the assembly 4 for coiling the wire 1, is fed to the guide roll 26, and is sent to the washer 30 for initial accumulation of the wire 1 in case the apparatus is to be set up. Under steady-state conditions, the ready wire 1 is directed through the laying device 27 to the coil 29 of the coiling device 28.

There is another operating duty of the coiling apparatus, whereat two wires 1 are directed under each spring-loaded roll 14 (ref. FIGS. 1, 3, 4 and 6). The distance between them and the diameter of the spring-loaded roll 14 are determined considering tolerances specified for the diameter of the wire 1 with provisions for producing a maximum drawing force.

In other respects, the coiling apparatus functions in the same manner as that described hereinabove.

The present invention permits easier maintenance of the coiling apparatus at high speeds of movement of the long-size product.

In addition, the coiling apparatus for long-size products according to the invention provides for cutting down the metal requirements in manufacture of the coiling apparatus and for reducing the power requirements in operation.

INDUSTRIAL APPLICABILITY

The coiling apparatus for long-size products corresponding to the invention and can find application in multihole production lines intended for manufacture of wire or metal strip bearing various coatings, and permits maintaining the rectilinear shape of said products during the drawing and coiling process, with the result that the fatigue life of the ready products increases by up to 25 percent.

We claim:

1. A coiling apparatus for long-size products, comprising:

means for rectilinearly drawing the long-size products;

means for coiling the long-size products spaced downstream of said drawing means and in the direction of movement of the long-size products;

said means for drawing the long-size products including at least one rotatable drive shaft and at least one rotatable spring-loaded roll having a flat outer peripheral surface with its axis parallel to the axis of said drive shaft and wherebetween the long-size product is passed, a fork for rotatably supporting the spring-loaded roll, and a guide rack receiving said fork for movement toward and away from said drive shaft, said drive shaft including a plurality of spaced, peripheral annular flutes each receiving a single long-size product and having a cross-sectional shape conforming to the cross-sectional shape of the long-size product and having a depth exceeding one-half of the thickness of the long-size product to provide increased surface contact area therebetween to maintain the shape of the product during drawing without imposing excessive plastic strains thereon.

2. A coiling apparatus as claimed in claim 1, wherein the number of the flutes is equal to the number of the spring-loaded rolls.

3. A coiling apparatus as claimed in claim 1, wherein two long-size products are pressed against the drive shaft by one spring-loaded roll.

4. A coiling apparatus as claimed in claim 1, wherein the drive shaft includes a plurality of annular rings on the periphery thereof, the number of rings being equal to the number of the spring-loaded rolls, the surface of each ring having a peripheral flute each receiving a single long-size product and conformed identically to the long-size product and having a depth exceeding $\frac{1}{2}$ of the thickness of the long-size product.

5. A coiling apparatus as claimed in claim 4, wherein a ring is positioned opposite each spring-loaded roll, the surface of each ring having a pair of flutes each receiving a single long-size product and conformed identically to the long-size product with a depth exceeding $\frac{1}{2}$ of the thickness of the long-size product.

6. A coiling apparatus as claimed in claim 1, wherein the spring-loaded rolls include annular peripheral rings.

7. A coiling apparatus as claimed in claim 1 or 3, wherein the means for drawing the long-size products includes means for adjusting the force required to press at least one spring-loaded roll toward the drive shaft.

8. A coiling apparatus as claimed in claim 3 or 5, wherein the means for drawing the long-size products include guide means for directing the long-size products to the flutes, with the guide means disposed upstream of the drive shaft in the direction of movement of the long-size products, and with the number of the guides equal to the number of the long-size products.

9. A coiling apparatus as claimed in claim 3 or 5, wherein a guide roll is installed between said drawing means and said coiling means.

* * * * *